United States Patent [19]

Boguth

[11] 4,274,761

[45] Jun. 23, 1981

[54] SUSPENSION ARRANGEMENT FOR SUSPENDING OF VIBRATING ELEMENTS AND THE LIKE

[75] Inventor: Kurt Boguth, Ratingen, Fed. Rep. of Germany

[73] Assignee: Tuenkers GmbH, Ratingen, Fed. Rep. of Germany

[21] Appl. No.: 42,717

[22] Filed: May 25, 1979

[30] Foreign Application Priority Data

Jun. 1, 1978 [DE] Fed. Rep. of Germany ..... 2823953

[51] Int. Cl.[3] ..... E02D 7/00

[52] U.S. Cl. ..... 405/232; 173/162 R; 188/1 B; 267/141.1

[58] Field of Search ..... 405/232; 188/1 B; 267/153, 141, 141.1; 173/162, 49; 272/137, 142

[56] References Cited

U.S. PATENT DOCUMENTS

| | | | |
|---|---|---|---|
| 2,415,983 | 2/1947 | Yerzley | 267/141.1 |
| 2,765,163 | 10/1956 | Muller | 267/153 |
| 3,109,639 | 11/1963 | Nicolaisen | 267/153 |
| 3,759,514 | 9/1973 | Cox | 272/137 |
| 3,828,864 | 8/1974 | Haverkamp et al. | 173/162 X |

FOREIGN PATENT DOCUMENTS

| | | | |
|---|---|---|---|
| 546780 | 4/1956 | Belgium | 267/141 |

*Primary Examiner*—Dennis L. Taylor
*Attorney, Agent, or Firm*—Michael J. Striker

[57] ABSTRACT

A suspension apparatus is provided for interposition between a support structure, such as a crane, and a vibratory device, such as a vibratory ram. The apparatus includes a sling element having two first ends spaced apart in the direction of pull, with one of the first ends suspended from the support structure and the other first end holding the vibratory device. The sling element also has two second ends, which second ends are spaced apart in a direction transverse of the pulling direction. A resiliently distortable damping element is interposed between the two second ends, and serves to dampen oscillations produced when the suspension apparatus is subjected to vibratory loading of the first ends.

19 Claims, 2 Drawing Figures

SUSPENSION ARRANGEMENT FOR SUSPENDING OF VIBRATING ELEMENTS AND THE LIKE

BACKGROUND OF THE INVENTION

The present invention relates to a suspension arrangement for suspending vibratory rams or other vibrating devices or bodies.

Vibratory rams are utilized for insertion or withdrawal of boards, posts, tubes, or other elements in construction of dams, canals, underground structures and the like. They are held by cables or iron carrying rings on a crane, a transverse, a frame, and the like. Vibrations which are developed during operation of the vibratory ram are transmitted in disturbing and disadvantageous manner more or less strongly to the cable system, the crane, the transverse and/or to other parts and locations. The resulting oscillating and striking action may be so strong that not only respective parts and bodies are subjected to high strains, but also considerable noise is produced with its detrimental action. These and other shortcomings and disadvantages always exist and are unavoidable when a vibratory ram is suspended and held by holding rings, hooks or other rigid members on a crane, a transverse, a frame or other parts. It has been shown that by suspending of the vibratory ram with the aid of conventional cables on a crane, a transverse, or a frame disadvantageous oscillations, impacts, strains, noise and other troubles cannot be prevented. The above-described suspension of the ram unavoidably negatively affects the transverse, the crane or the frame and causes oscillations and displacement of the same which leads, under some conditions, to damage and operational failures or even to breakage and destruction of one or several parts of the arrangement.

Vibratory rams are known which are provided with spiral pressure springs for dampening the oscillations. Such rams have a disadvantage that they are highly susceptible to damage and produce high noise. High dynamic force is developed during operation of these rams which result in unavoidable harmful contact and forced impact between individual convolutions of the spiral pressure spring. Guides which in this case are provided for the springs are complicated and contact with the spring with friction. The guides are unfavorable and disadvantageous inasmuch as they are subjected to high wear and high heating, especially in the conditions of frequencies in the region of natural resonance. Very disadvantageous is ineffectiveness of such pressure spring arrangement resulting from the fact that when the required pulling action is applied to the spring, the convolutions of the spring are pressed to each other so that the spring acts as a "block" and does not absorb undesirable oscillations.

It is also known to utilize a rubber block corresponding to a pulling head, instead of the spiral pressure spring. Arrangements with the spiral springs or with the rubber blocks must guarantee good dampening of oscillations in conditions of high tangential stresses with respective relatively high static prestressing. When a necessary great load is applied, the pulling head of the known arrangements must be located very high so that the arrangement has a disadvantageously abnormal height and very unfavorable total center of gravity for the vibratory rams. In these cases during operation there is a danger of damaging, breaking and/or failures of parts of the vibratory rams and/or of the rammer elements.

SUMMARY OF THE INVENTION

Accordingly, it is an object of the present invention to provide a suspension arrangement which avoids the disadvantages of the prior art.

More particularly, it is an object of the present invention to provide a suspension arrangement for suspending a vibratory ram or other vibrating devices or bodies, in which transmission of undesirable and disadvantageous vibrations and displacements of the suspended elements is prevented.

In other words, it is an object of the invention to provide an oscillation-absorbing suspension element, hanger and the like for a vibratory ram or similar vibrating or movable devices or bodies.

In keeping with these objects and with others which will become apparent hereinafter, one feature of the present invention resides, briefly stated, in a suspension arrangement which has a sling element having two first ends spaced from one another in a pulling direction and two second ends spaced from one another in a direction which is transverse to said pulling direction, and a dampening element extending in the transverse direction between the two second ends so that when a vibrating element is suspended on one of the first ends of the sling element, the latter varies its shape, the distance between the two second ends varies, and the dampening element moves in the transverse direction so as to dampen the oscillations.

The sling element may be formed as an endless cable, wire, band or the like, or as four endless slings of a cable, a wire, a band, or the like. Two carrying plates may be arranged at two first ends of the sling element, and two guiding and mounting plates may be arranged at two second ends of the same so that the dampening element is located between the guiding and mounting plates. The dampening element may be formed as a one-piece member or may include a plurality of members constituted of rubber or the like material.

The suspending arrangement is suspended on a crane, a frame, a transverse, a platform or the like by means of one of the carrying plates, whereas the other carrying plate holds the vibratory ram or another vibrating device or body. The distance between the carrying plates increases as a result of the weight of the vibrating ram and the vibrations generated by the latter. This variation of the distance and the vibrations are transmitted through the endless sling element to both guiding and mounting plates, and further to the dampening element located between the latter. Oscillations which are generated by loading of the vibratory ram or any other body or device suspended on the lower carrying plate are transmitted in supressed manner or fully absorbed. Thereby, no vibrations and movements or only dampened vibrations and movements pass through the upper carrying plate to the crane, the transverse, the frame, or the platform. The suspension arrangement is so formed and arranged that when pulling or pressing forces are applied, the shape of the sling element varies, and the endless sling element or the multiple-sling element allows respective freedom of movement of the guiding and mounting plates in a direction which is transverse to the pulling direction.

The guiding and mounting plates are immovably mounted on the sling element. Similarly, the carrying plates are also immovably mounted on the sling element. The dampening element or several dampening elements extend between the guiding rod and mounting plates. The dampening elements are constituted of rubber, synthetic plastics and other elastic materials and operate advantageously without noise. When such dampening elements are utilized the disadvantageous formation of a "block" under the action of high pulling forces is eliminated.

The carrying plates, as well as the guiding and mounting plates may be immovably mounted on the endless cable, wire, band and the like by means of a clamp strap, a holding ring, a holding hook, a holding ear, and the like. The carrying plates and the guiding and mounting plates may be provided with pins, and the sling element may be composed of four endless sling members pivotally connected with the pins of the plates. Two of these endless sling members hold each of the plates. Thereby, the carrying plates and the guiding and mounting plates are uniformly immovably mounted on the endless sling element.

The required location of the dampening element transverse to the pulling direction may be guaranteed by particular arrangement and means between the guiding and mounting plates. It is possible to utilize one or several dampening members. Advantageously, the dampening element may be formed as a pressure spring. It may have cylindrical, spherical, angular or another shape.

The known pull heads are usually provided with elements for dampening of oscillations. However, the dampening devices which are utilized in them do not satisfy the requirement made to such arrangements. The disadvantages of the known pulling heads are the great height of the arrangement and high weight of the latter. In contrast, the inventive suspension arrangement eliminates the oscillations of the pull head so that the vibratory rams can be located lower and can have a smaller weight.

The novel features which are considered as characterstic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
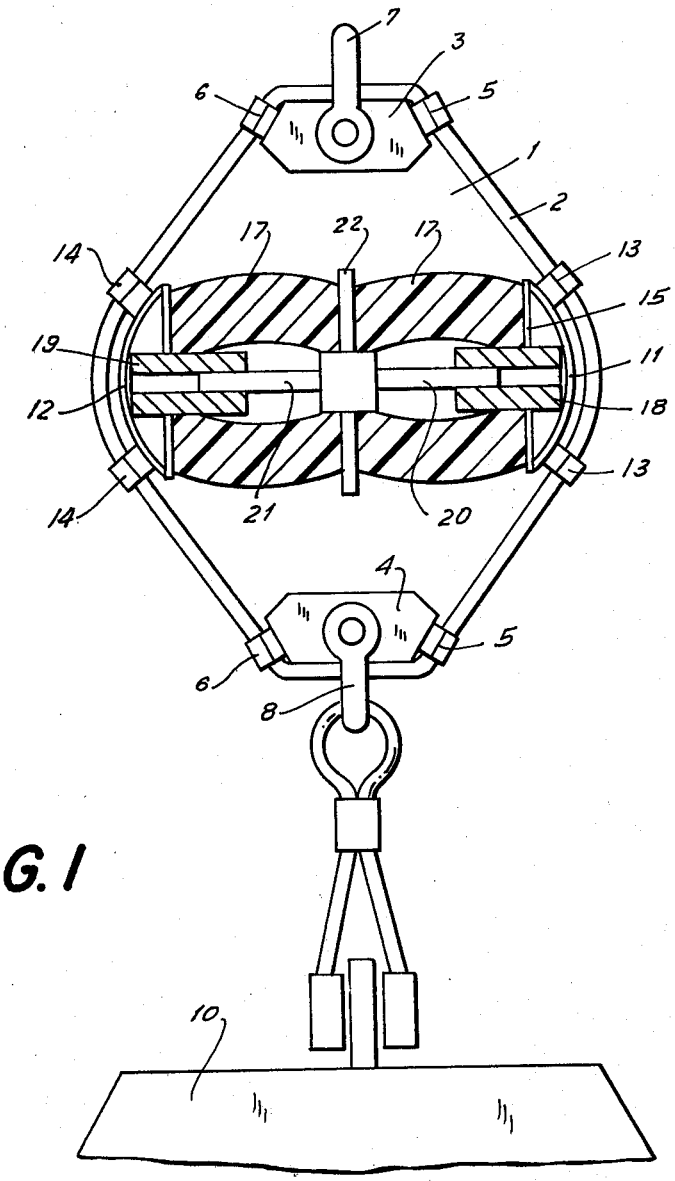
FIG. 1 is a view showing a suspension arrangement with an endless sling element in accordance with the present invention.

A suspension arrangement shown in FIG. 1 has an endless sling element 1 formed by an endless cable, a band, a wire or the like 2 which is constituted by steel, synthetic plastic or other material. The endless sling element 1 holds two carrying plates 3 and 4 which are located at opposite ends of the sling element 1. The carrying plates 3 and 4 are connected with the cable 2 by clamp straps, holding rings, holding hooks, holding ears and the like 5 and 6. One of the carrying plates 3 is connected with a carrying hook or another element 7 for suspending the arrangement on a crane, a frame, a transverse or the like. The other carrying plate 4 has a carrying hook or the like element 8 on which a vibratory ram 10 or another device or body is suspended by means of a cable or another element 9.

The carrying plates 3 and 4 are arranged on the endless sling element 1 so that they are located opposite to one another in a pulling direction. Two guiding and mounting plates 11 and 12 are further provided. The guiding and mounting plates 11 and 12 are spaced from one another in a direction which is transverse to the pulling direction and located in middle regions between the carrying plates 3 and 4. The guiding and mounting plates 11 and 12 are connected with the endless cable 2 by clamp straps, holding rings, holding hooks, holding ears and the like 13 and 14.

The guiding and mounting plates 11 and 12 are immovably connected with the endless cable 2. A pressing disc 15 is associated with the guiding and mounting plate 11, whereas a pressing disc 16 is associated with a guiding and mounting plate 12. A dampening element 17 having a variable length is located between the pressing discs 15 and 16. The dampening element 17 is constituted of rubber or a synthetic plastic material. The guiding and mounting plates 11 and 12 and the pressing discs 15 and 16 are so arranged that the dampening element 17 extends in a direction which is transverse to the pulling direction.

When the cable 2 is loaded at its lower end, that is when the vibratory ram 10 is suspended on the cable 9 connected by the hook 8 with the lower carrying plate 4, the distance between the carrying plates 3 and 4 is varied. The cable 2 varies its shape, and the load is transmitted through the cable 2 as a pressing force to the dampening element 17. The length of the dampening element 17 respectively and elastically varies. It is advantageous that even in the cases when high loads are applied to the inventive suspension arrangement and the cable is strongly pulled, the disadvantageous "pressing on a block" is avoided. A further advantage is noiseless operation of the dampening element of rubber or another synthetic plastic material.

The dampening element 17 may be formed as a one-piece member or may be composed of several parts. It may have a cylindrical shape or other shapes. In dependence upon operational conditions, the dampening element 17 may be partially or completely solid or hollow. Guide bushes 18 and 19 may be provided on and between the guiding and mounting plates 11 and 12 with their pressing discs 15 and 16. The guide bushes are arranged for holding, guiding and moving of the dampening element 17. Guiding rods 20 and 21 are located in the guide bushes 18 and 19 and connected with a central plate or disc 22. The dampening element 17 may be connected with the pressing discs 15 and 16 releasably or non-releasably. The carrying plates 3 and 4 are immovably connected with the cable 2.

Figure 2:
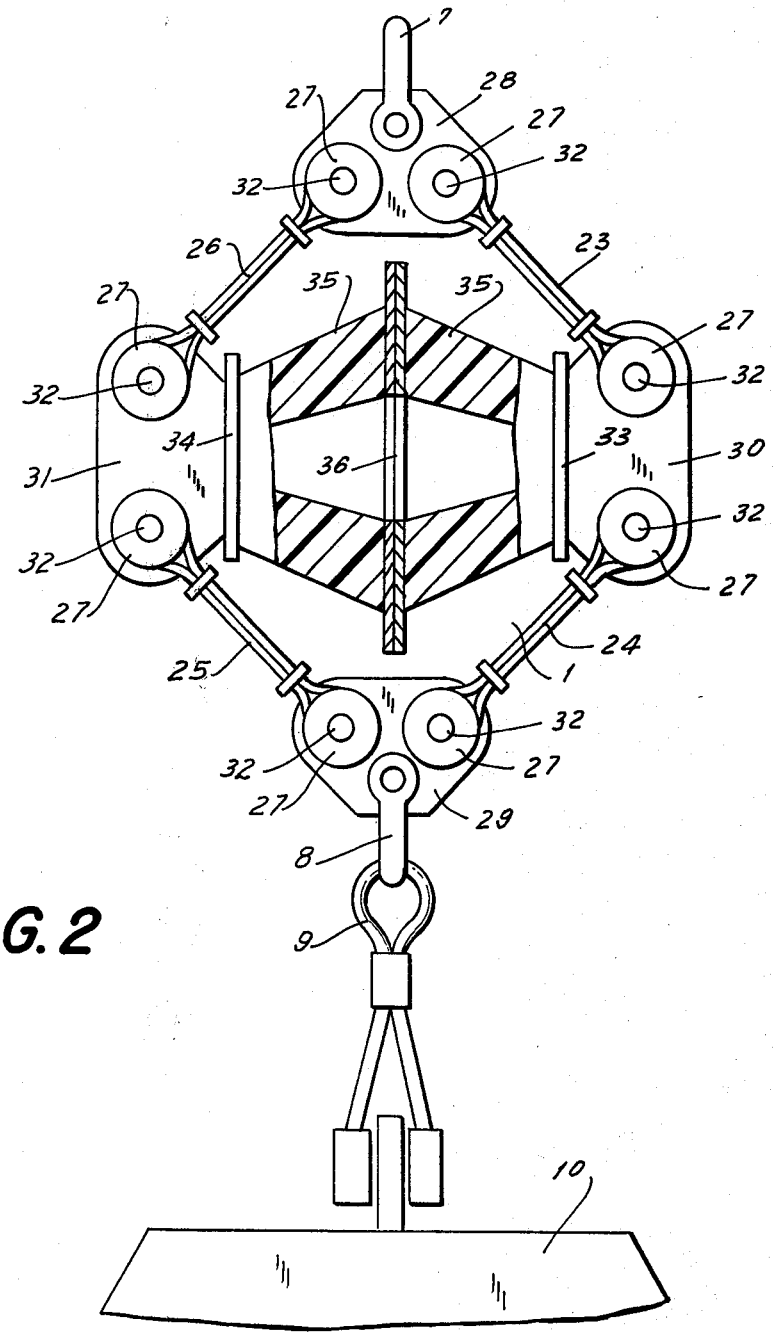
FIG. 2 is a suspension arrangement with a sling element composed of four endless sling members.

FIG. 2 shows a suspension arrangement in accordance with another embodiment of the present invention. The sliding element in accordance with this embodiment is composed of four endless sling members 23, 24, 25 and 26. Each of the sling members 23–26 is formed by an endless cable, band, wire or the like, which is constituted of steel, synthetic plastic or another material. Each of the endless sling members 23–26 is provided at both its ends with an ear, an eye or the like 17 so as to form a strand.

The four endless sling members 23–26 are connected with two carrying plates 28 and 29 and with two guiding and mounting plates 30 and 31 so as to form together the endless sling element 1. The carrying plates 28 and 29 are spaced from one another in the pulling direction.

The guiding and mounting plates 30 and 31 are located between the carrying plates 28 and 29 and are spaced from one another in a direction which is transverse to the pulling direction. Each of the carrying plates 28 and 29 and each of the guiding and mounting plates 30 and 31 is provided with two pins or the like 32 for connecting with the endless slings 23–26. Thereby, each endless sling 23–26 is pivotally connected by the ear or eye 27 at its one end with one of the pins 32 of the carrying plates 28 and 29, and is pivotally connected by the ear or eye 27 at its other end with the pin 32 of one of the guiding and mounting plates 30 or 31.

The guiding and mounting plate 30 is provided with a pressing disc or the like element 33, whereas the guiding and mounting plate 31 is provided with a pressing disc or the like element 34. A dampening element 35 is located between the pressing discs 33 and 34 and its longitudinal axis extends in a direction which is transverse to the pulling direction. The dampening element 35 is advantageously constituted of rubber or a synthetic plastic material. Advantageously, the dampening element 35 is formed as a hollow tapered sleeve. It is also possible that the dampening element has a cylindrical, angular, or another shape corresponding to objects of the arrangement.

The pressing discs 33 and 34 may advantageously be provided with through-going openings or similar formations for receiving and holding of adjacent end portions of the dampening element 35. As can be seen from FIG. 2, the dampening element is composed of two dampening members 35 having a shape of a truncated cone. It is advantageous when a one-piece or multiple-piece base plate 36 is arranged between the dampening members 35 for holding the latter in their predetermined positions. The proximal ends of the dampening members 35 can be secured to the base plate 36 by vulcanization or other methods.

Similarly to the arrangement shown in FIG. 1, the arrangement shown in FIG. 2 may be suspended by the carrying hook 7 to a crane, a transverse, a frame or the like. The vibratory ram 10 may be suspended on the arrangement by the carrying hook 8 and the cable connected therewith. Under the action of load, the distance between the carrying hooks 7 and 8 in the pulling direction is varied. The sling element 1 varies its shape, and the load is transmitted through the pressing plates 33 and 34 as a pressing force to the dampening element 35 which extends in the transverse direction. This force is absorbed by the dampening element 35. The construction and location of parts of the inventive suspension arrangement guarantees noiseless and distortionless operation. The dampening element which operates as a pressure spring makes possible taking up of high pressures.

The suspension arrangement with dampening of oscillations, in accordance with the invention, makes possible to provide and to utilize the pulling head without its own dampening of oscillations inasmuch as dampening of oscillations is performed by the arrangement. Thereby, the vibratory ram can be located considerably lower and manufactured with weight economy. The arrangement has considerably smaller height with a relatively smaller weight. This is especially advantageous and makes possible utilization of the vibratory ram in heavier operations and conditions and provides for various applications of the suspension arrangement.

It will be understood that each of the elements described above, or two or more together, may also find a useful application in other types of constructions differing from the types described above.

While the invention has been illustrated and described as embodied in a suspension arrangement it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and described to be protected by Letters Patent is set forth in the appended claims:

1. A suspension arrangement for suspending a vibratory ram and the like vibratory devices or bodies, comprising a sling element having two first upper and lower ends spaced from one another in a vehicle first direction and two second lateral ends spaced from one another in a second transverse direction which is transverse to said first vertical direction; carrying plates mounted at the respective first ends; first and second suspending means each connected to one of said carrying plates so that, when said sling element is suspended from one of said suspending means and a vibrating element is suspended from the other of said suspending means, said sling element varies its shape whereby the respective distances between said first ends and between said second ends are varied; and a dampening element located between said second ends of said sling element and movable in said transverse direction so that when said sling element is loaded by the vibrating element suspended on said one first end and the distance between said second ends is varied, a compressing force acts upon said damping element in said transverse direction.

2. A suspension arrangement as defined in claim 1, wherein said sling element is a cable.

3. A suspension arrangement as defined in claim 1, wherein said sling element is a wire.

4. A suspension arrangement as defined in claim 1, wherein said sling element is a band.

5. A suspension arrangement as defined in claim 1, wherein said sling element is composed of four endless sling members movably connected with one another.

6. A suspension arrangement as defined in claim 1, and further comprising two guiding and mounting plates each located at a respective one of said second ends and connected with said sling element, said damping element being located between said guiding and mounting plates.

7. A suspension arrangement as defined in claim 1, wherein said dampening element is a one piece member.

8. A suspension arrangement as defined in claim 1, wherein said dampening element includes a plurality of dampening members.

9. A suspension arrangement as defined in claim 1, wherein said dampening element is constituted of rubber.

10. A suspension arrangement as defined in claim 5, wherein said endless sling members have identical lengths and identical thicknesses.

11. A suspension arrangement as defined in claim 6, wherein said dampening member has two ends spaced from one another in said transverse direction, each of said guiding and mounting plates being associated with a respective one of said ends of said dampening member so as to serve for predetermined holding and moving of said dampening element.

12. A suspension arrangement as defined in claim 1; and further comprising two guiding and mounting plates each located at a respective one of said second ends so as to serve for holding and moving of said dampening element, said distances being measured between said first-mentioned plates and said second-mentioned plates, respectively, and being varied simultaneously with each other.

13. A suspension arrangement as defined in claim 12, wherein each of said plates is immovably connected with said sling element; and further comprising connecting means for connecting said plates with said sling element and including a plurality of connecting members.

14. A suspension arrangement as defined in claim 13, wherein each of said connecting members is a clamp strip.

15. A suspension arrangement as defined in claim 13, wherein each of said connecting members is a holding ring.

16. A suspension arrangement as defined in claim 13, wherein each of said connecting members is a holding hook.

17. A suspension arrangement as defined in claim 13, wherein each of said connecting members is a holding ear.

18. A suspension arrangement for suspending a vibratory ram and the like vibratory devices or bodies, comprising a sling element including four endless sling members and having two first ends spaced from one another in a first direction and two second ends spaced from one another in a second direction which is transverse to said first direction, said sling element being arranged so that when a vibrating element is suspended at one of said first ends and thereby said sling element is loaded and is pulled in said first direction, said sling element varies its shape whereby the distances between said first ends and between said second ends are varied; a dampening element located between said second ends of said sling element and movable in said transverse direction so that when said sling element is loaded by the vibrating element suspended on said one first end and the distance between said second ends is varied, a compressing force acts upon said damping element in said transverse direction; and two carrying plates each arranged at a respective one of said first ends and two guiding and mounting plates each located at a respective one of said second ends so as to serve for holding and moving of said dampening element, said distances being measured between said first-mentioned plates and said second-mentioned plates, respectively, and being varied in dependence upon and simultaneously with each other, each of said plates being held by two of said endless sling members so that said carrying plates are spaced from one another in said first direction and said guiding and mounting plates are spaced from one another in said second direction which is transverse to said first direction.

19. A suspension arrangement as defined in claim 18, wherein each of said endless sling members has two spaced end portions one of which is connected with one of said carrying plates whereas the other end portion is connected with a respective one of said guiding and mounting plates.

* * * * *